US007086857B2

(12) United States Patent
Lai et al.

(10) Patent No.: US 7,086,857 B2
(45) Date of Patent: Aug. 8, 2006

(54) USE OF THERMAL INSULATION FOR NOISE ABATEMENT

(75) Inventors: Heng-Yi Lai, Manlius, NY (US); Sivakumar Gopalnarayanan, Simsbury, CT (US); Paul M. Haydock, Zionsville, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/894,830

(22) Filed: Jul. 20, 2004

(65) Prior Publication Data

US 2006/0019210 A1 Jan. 26, 2006

(51) Int. Cl.
*F27D 1/00* (2006.01)

(52) U.S. Cl. ..... 432/251; 432/248; 181/224; 181/292

(58) Field of Classification Search ..... 432/251, 432/247, 248, 252; 52/396.01, 396.09; 181/224, 181/293, 292, 294
See application file for complete search history.

(56) References Cited

U.S. PATENT DOCUMENTS

| | | | | |
|---|---|---|---|---|
| 3,748,085 | A * | 7/1973 | Poepsel et al. | 431/114 |
| 3,929,186 | A * | 12/1975 | Becker | 165/49 |
| 4,379,191 | A * | 4/1983 | Beggs et al. | 428/118 |
| 4,475,621 | A * | 10/1984 | Cherington et al. | 181/212 |
| 5,334,806 | A * | 8/1994 | Avery | 181/286 |
| 6,183,837 | B1 * | 2/2001 | Kim | 428/118 |
| 6,534,145 | B1 * | 3/2003 | Boyles | 428/92 |
| 6,769,512 | B1 * | 8/2004 | Bargo | 181/290 |
| 6,868,940 | B1 * | 3/2005 | Mekwinski | 181/290 |

* cited by examiner

*Primary Examiner*—Gregory Wilson
(74) *Attorney, Agent, or Firm*—Wall Marjama & Bilinski LLP

(57) ABSTRACT

In a residential furnace having a layered insulation material on the inner walls of the heat exchanger compartment, the inner aluminum foil layer has a plurality of holes formed therein in order to allow for the outer layer to absorb the sound within the heat exchanger compartment and thereby reduce the noise emanating from the furnace. Both the density and size of the holes are optimized to maximize the sound absorption performance over the particular frequency ranges that are characteristic of the furnace.

16 Claims, 4 Drawing Sheets

USE OF THERMAL INSULATION FOR NOISE ABATEMENT

BACKGROUND OF THE INVENTION

This invention relates generally to residential furnaces and, more particularly, to the use of thermal insulation in a heat exchanger housing for reducing the level of noise emanating from the furnace.

In order to increase the efficiency of a residential furnace, thermal insulation is generally applied to the inner side of the furnace casing to reduce the heat loss that would otherwise occur. Current furnaces generally apply a two layered insulation structure on the furnace interior walls surrounding the heat exchanger compartment to reduce the heat loss. The outer layer of the insulation structure is commonly a fiberglass blanket, and the inner layer is commonly a thin covering sheet of an aluminum foil material. The cover layer serves two purposes: to reduce thermal loss by reflecting heat back from the walls of the furnace casing and to prevent glass fiber in the outer layer from flowing into the ventilation duct.

The noise from a furnace typically originates from these primary sources: the blower that passes air over the heat exchangers, the inducer that draws air into the heat exchanger and the burners that introduce fuel/air mixtures to be ignited at the entrance to the heat exchanger cells. Generally, as the heating capacity is increased, so is the noise that is created.

Although efficiency of a furnace is considered to be very important to the homeowner, furnace noise, caused in a large part by the blower in passing the return air through the heat exchanger compartment and into the ventilation ducts, is also a concern to the homeowner. Accordingly, a small sacrifice in efficiency may be readily accepted for a substantial reduction in the amount of noise emanating from the furnace into the ducts.

SUMMARY OF THE INVENTION

Briefly, in accordance with one aspect of the invention, the inner cover sheet of a thermal insulation blanket in the heat exchanger compartment of a residential furnace has a plurality of holes formed therein so as to allow the sound to pass therethrough and be dissipated by: (1) absorption by the fiberglass insulation material in the outer layer of the insulation structure and (2) the edges of the holes providing friction to the air particles flowing back and forth through the holes (similar to the Helmholtz resonator concept). In this way, the effectiveness of the inner layer as a heat reflector is only slightly reduced while, at the same time, the inner layer is made to function as a Helmholtz resonator and the outer layer is made to function not only as a thermal insulation blanket but also as a sound absorption blanket.

In accordance with another aspect of the invention, the size and density of the holes in the cover layer are optimized so as to cause abatement of the more dominant noise frequencies that characterize a particular furnace design.

By another aspect of the invention, the thermal/acoustic installation is implemented by first securing the inner layer of insulation to the outer layer and then forming the holes of predetermined size and location. The layered structure is then installed on the inner walls of the heat exchanger compartment.

In the drawings as hereinafter described, a preferred embodiment is depicted; however, various other modifications and alternative constructions can be made thereto without departing from the true spirit and scope of the invention.

DETAILED DESCRIPTION OF THE INVENTION

Figure 1:
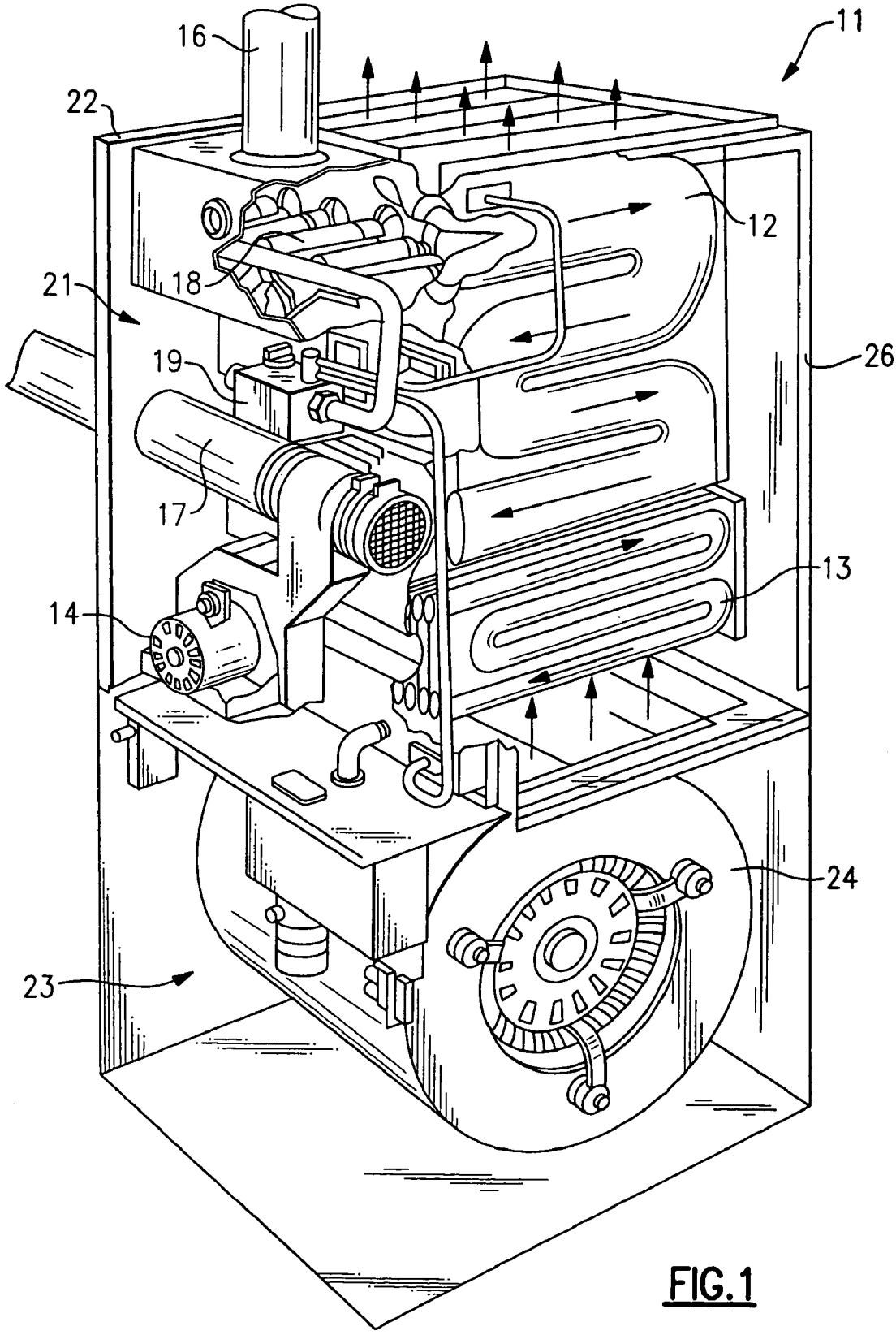
FIG. 1 is a cut away perspective view of a gas furnace having the present invention incorporated therein.

Referring now to FIG. 1, a gas furnace of the type which is readily adaptable for use with the present invention is shown generally at 11 and includes a primary heat exchanger 12 that fluidly communicates with a condensing heat exchanger 13. An inducer 14 is fluidly connected to one end of the condensing heat exchanger 13 and acts to draw air in from an air inlet 16 through the primary heat exchanger 12 and the condensing heat exchanger 13 and to discharge the air through an exhaust vent 17.

A plurality of burners 18 are provided with each being disposed at one end of a cell of the primary heat exchanger 12 and provided with a flow of gas from a valve 19. The gas is ignited at the burner and the air passing into the primary heat exchanger 12 is heated, with the temperature of the air then decreasing as it is passed down through the primary heat exchanger 12 and the condensing heat exchanger 13, with a portion of the heated air condensing to a liquid as it passes through the condensing heat exchanger 13. The primary heat exchanger 12 and the condensing heat exchanger 13 are contained within a heat exchanger compartment 21 having side walls 22.

It should be recognized that, although the invention is being described in terms of use with a condensing furnace, it is equally applicable to a furnace with a non-condensing furnace with only one heat exchanger.

Below the heat exchanger compartment 21 is a blower compartment 23 wherein a blower 24 is disposed. The blower 24 draws air in from a return air vent (not shown) and discharges it upwardly into the heat exchanger compartment 21 as shown by the arrows. Within the heat exchanger compartment 21, the air passes first over the condensing heat exchanger 13 where it picks up the heat of the condensing gases. Then it flows over the primary heat exchanger 12 to be further heated before flowing out the top of the furnace to a supply air vent (not shown) for heating a space.

It will be understood that the heat exchanger compartment 21 is at a relatively high temperature compared with the space surrounding the furnace. Accordingly, an insulation blanket 26 is applied to each of the side walls 22 to reduce the amount of heat that flows outwardly from the heat exchanger compartment 21 to the area surrounding the furnace 11.

Figure 2:
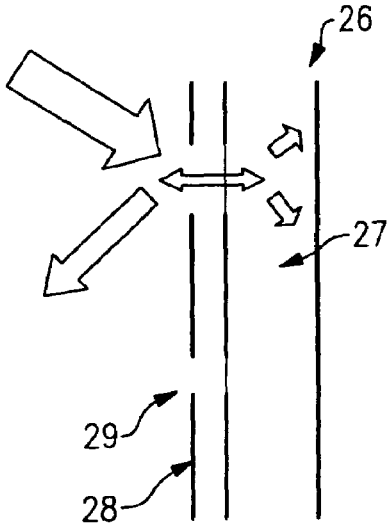
FIG. 2 is a schematic partial side view illustration of the insulation portion thereof in accordance with the present invention.

A side view of a portion of the insulation blanket is shown in FIG. 2. The blanket 26 includes on its outer side, a relatively thick thermal insulation element 27 and on its inner side, a relatively thin thermal reflector element or cover sheet 28. The thermal insulation element 27 is preferably made of a mat of glass fibers that are light in weight, inexpensive in cost, and which have very high insulation properties. The thermal reflector element 28 is preferably an aluminum foil that is attached to the thermal insulation element 27 by way of an adhesive of the like. The purpose of the aluminum facing is to reflect the heat from the heat exchanger compartment 21 back into the heat exchanger compartment 21. Of course, other materials may be substituted for the aluminum foil and fiberglass matting, such as a heat reflective plastic composite type of material for the cover sheet 28 and an open cell foam made of polyimide or polyurethane for the insulation element 27.

The thermal reflector element 28 has a plurality of holes 29 formed therein for purposes of noise attenuation. That is, the holes 29 allow air particles to pass through the aluminum foil 28 and into the thermal insulation element 27 to be absorbed. Some of the air particles pass back through the holes as shown and in doing so further sound attenuation occurs. In these ways, the level of noise passing from the heat exchanger compartment 21 to the vents of the supply air is substantially reduced.

The holes 29 may be first formed in the cover sheet 28 which is then attached to the thermal insulation element 27. However, because of the general fragility of such a thin foil material, it is preferable that the foil cover sheet 28 be first attached to the thermal insulation element 27, as by gluing, and then have the holes 29 formed therein such as by punching with a spiked roller.

The distribution of the holes 29 may be random but are preferably distributed in a uniform pattern. It is the density (i.e. the percentage of the total surface of the cover sheet 28 that is occupied by the space of the holes 29) that is important in obtaining the best results of the present invention.

Although the holes 29 are desirable for purposes of noise reduction as discussed hereinabove, their presence will reduce the effectiveness of the aluminum foil 28 in performing its primary functions i.e. that of reflecting heat inwardly and preventing the flow of glass fiber particles from separating from the thermal insulation element 27 and passing out into the furnace duct work. Accordingly, the distribution and the sizes of the holes are preferably optimized so as to obtain a desired amount of sound attenuation while, at the same time, not substantially reducing the effectiveness of the aluminum foil's primary functions.

Since the frequency spectrum of the sound absorbing characteristics (e.g. normal sound coefficient) of a perforated foil depends on the hole diameter and perforation ratio, it is possible to optimize the perforated foil so that the sound absorption coefficient of the two layered thermal insulation has a maximum peak close to the frequency of the major noise source.

A design chart for selecting desired hole size and perforation ratio for a 0.5 mil aluminum foil and a 0.5 inch fiberglass blanket was generated based on analytical models. The averaged sound absorption coefficient over a frequency range of 100 Hz to 10 kHz was calculated for hole diameters from 0.05 mm to 5 mm and perforation % from $10^{-3}$% to 10'%, and contours of averaged absorption coefficients were plotted as shown in FIG. 1. The formula to calculate the number of holes per square inch was as follows:

$$N = 8.2144\frac{C}{D^2},$$

where C is the perforation rate in percentage, (i.e. the percentage of the total surface that is occupied by the space of the holes 29) and D is the hole diameter in millimeters.

Figure 3:
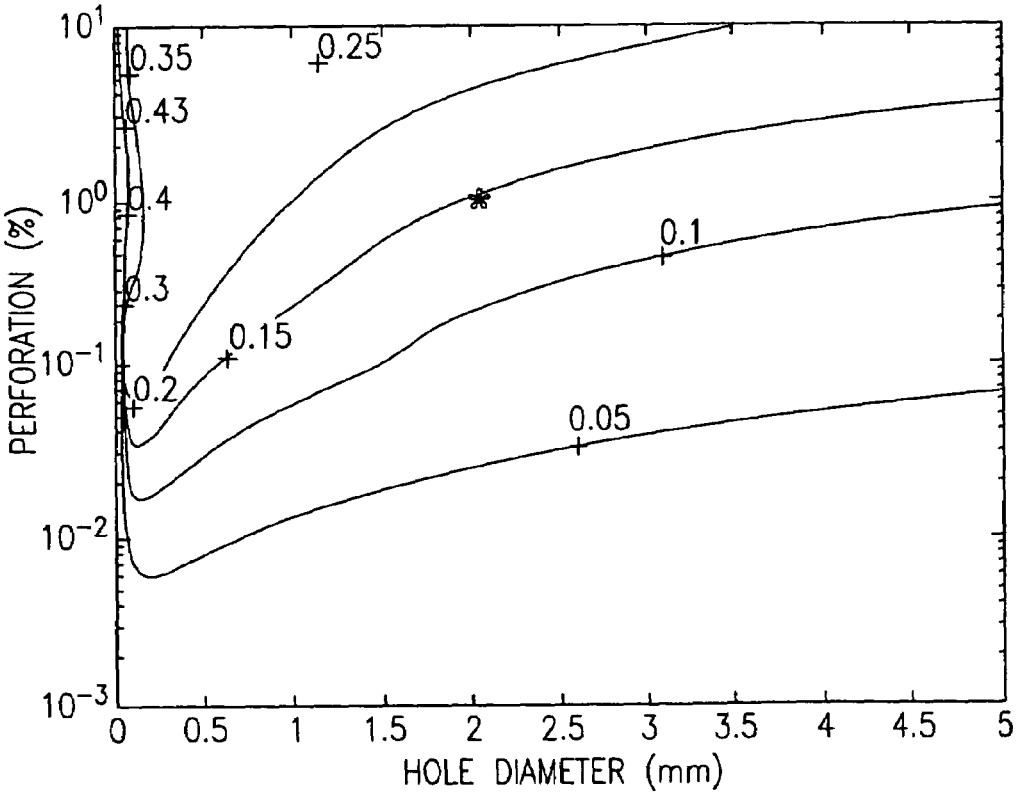
FIG. 3 is a graphic illustration of the averaged sound absorption coefficient as a function of both hole diameter and perforation percentage over a range of frequencies.

The contours shown in FIG. 3 therefore represent averaged normal sound absorption coefficient levels. One percent (1%) perforation (i.e. 10° on FIG. 3) with a hole diameter of 2 mm (about two holes per square inch) will result in an averaged sound absorption coefficient of about 0.15 as shown by the star.

Figure 4:
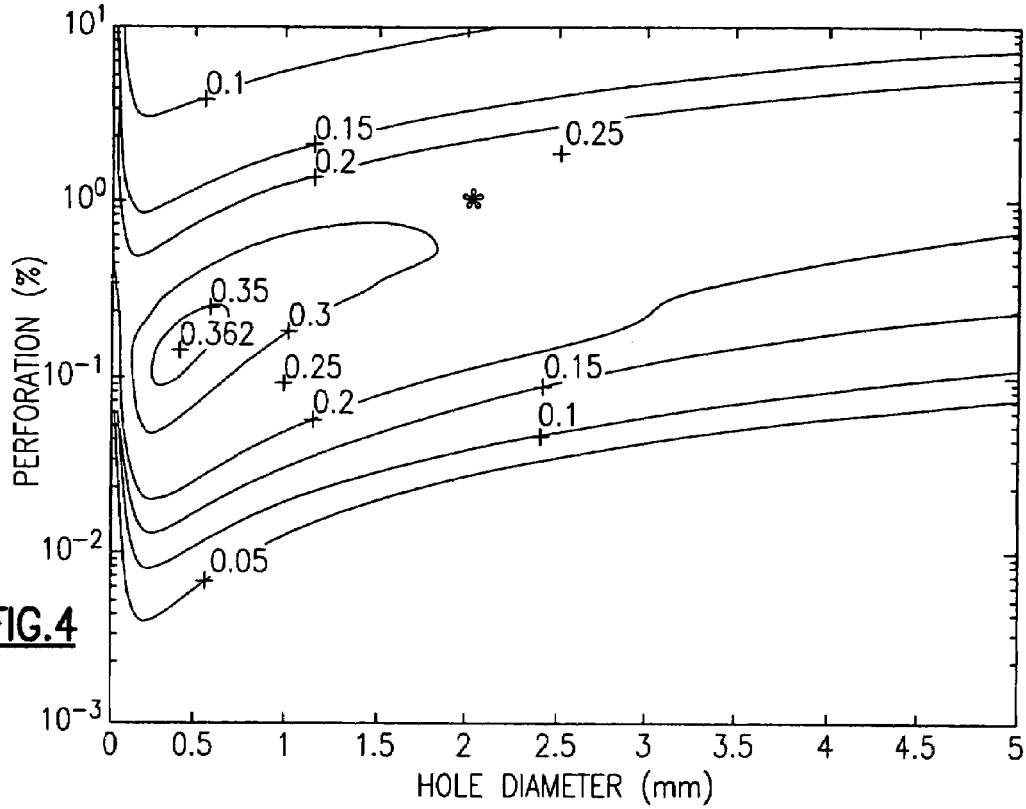
FIG. 4 is a graphic illustration of a noise reduction coefficient as a function of both hole diameter and perforation percentage.

It will be recognized from FIG. 3 that the best performer is one having an averaged sound absorption coefficient of 0.43, but would require 33,014 of 0.025 mm holes per square inch. However, this was calculated on the basis of a very wide frequency range of 100 Hz to 10 kHz. Accordingly, a second design chart was generated to show the NRC (noise reduction coefficient) as a function of hole diameter and perforation percentage but with a focus on the frequency range more critical to furnace operation as shown in FIG. 4. The noise reduction coefficient, NRC, is defined as the average absorption coefficients at 4 octave bands of 250 Hz, 500 Hz, 1000 Hz and 2000 Hz, where on $$NRC = \frac{\alpha_{250} + \alpha_{500} + \alpha_{1000} + \alpha_{2000}}{4}.$$

Again the contours show equal levels of NRCs. For example, a 1% perforation of a 2 mm hole achieved an NRC of 0.286 as shown by the star.

The best design from FIG. 4 has an NRC value of 0.362, which can be achieved with a perforation percentage of about 0.1% and a hole diameter of about 0.35 mm. Thus, it should require about 9.5 of 0.35 mm holes per square inch.

Referring now to Table 1 below, reference is made to data obtained by a statistical energy analysis (SEA) approach wherein the typical noise characteristics of the residential furnace industry are considered, and the two best performers as shown in FIGS. 3 and 4 above were applied by way of modeling, to those frequencies. Table 1 shows that the maximum NRC (i.e. FIG. 4) actually achieves better overall noise reduction in both sound pressure level (SPL) and sound power level (PWL) than the maximum averaged sound absorption coefficient (i.e. FIG. 3).

TABLE 1

| SEA Predictions | Max. NRC perforated foil | Max. ave. abs. perforated foil |
|---|---|---|
| ΔSPL | 1.0 dBA | 0.8 dBA |
| ΔPWL | 0.8 dBA | 0.7 dBA |

Figure 5:
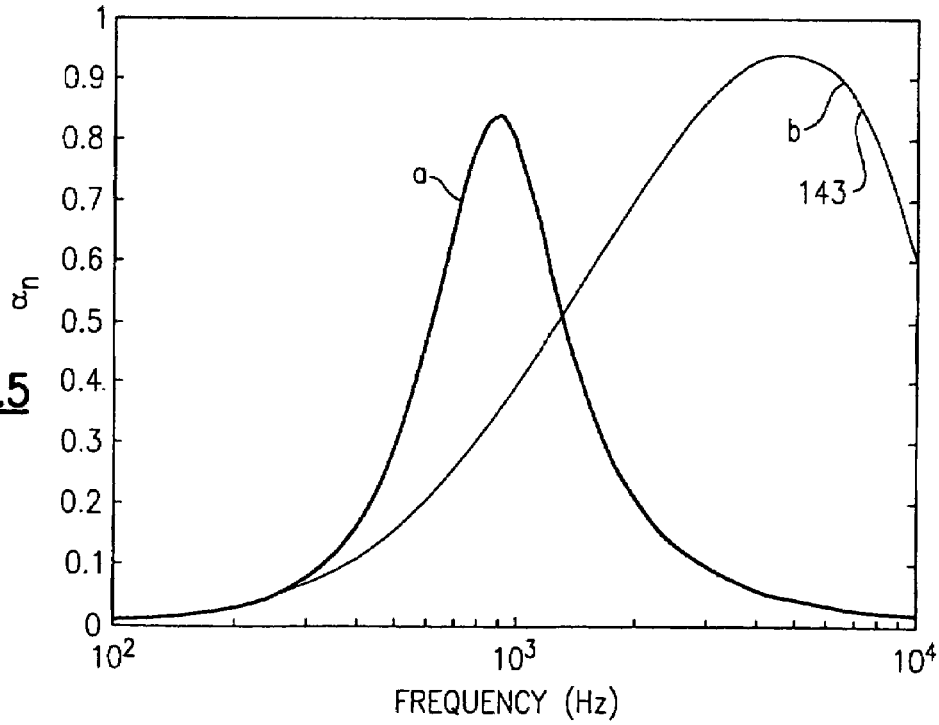
FIG. 5 is a graphic illustration of the sound absorption coefficients for two optimized perforated fiberglass blankets over a range of frequencies.

This performance comparison can be discussed in a different way by reference to FIG. 5. Here, it will be seen that the maximum NRC performance curve "a" occurs at around 1,000 Hz, and the frequency range covered by that curve is relatively narrow. The maximum averaged sound absorption coefficient curve "b", on the other hand, covers a broader frequency range and has its maximum performance at around 7,000 Hz. Thus, it may appear from FIG. 5 that the maximum averaged sound absorption coefficient design would be preferred over the max NRC design. However, from the data in Table 1, it can be concluded that the typical frequencies of residential furnaces in the industry are closer to the 1,000 Hz frequency, and therefore the max NRC curve "a" design is actually preferred over the other "b" curve. One of the reasons for this is that the NRC curve takes into account the sensitivity of the human ear. Thus, not only is the max NRC design more practical to implement with its much fewer numbers and relatively larger holes, but it is also superior in performance when considering human perception.

It should be recognized that, even though there has been only two approaches shown as to the manner in which optimized performance is obtained from the perforated sheets, other factors and methods can also be incorporated in making these calculations. Ideally, when designing the insulation for any particular furnace, the noise characteristics of that furnace should be determined so that the perforation percentage and hole size can be tailored to maximize the sound absorption characteristics for the particular frequencies that characterize that furnace. In this regard, FIGS. 6 and 7 show families of curves that indicate, for a particular fiberglass blanket design with a perforated cover sheet, the sound absorption coefficient $\alpha_N$ a function of frequency.

Figure 6:
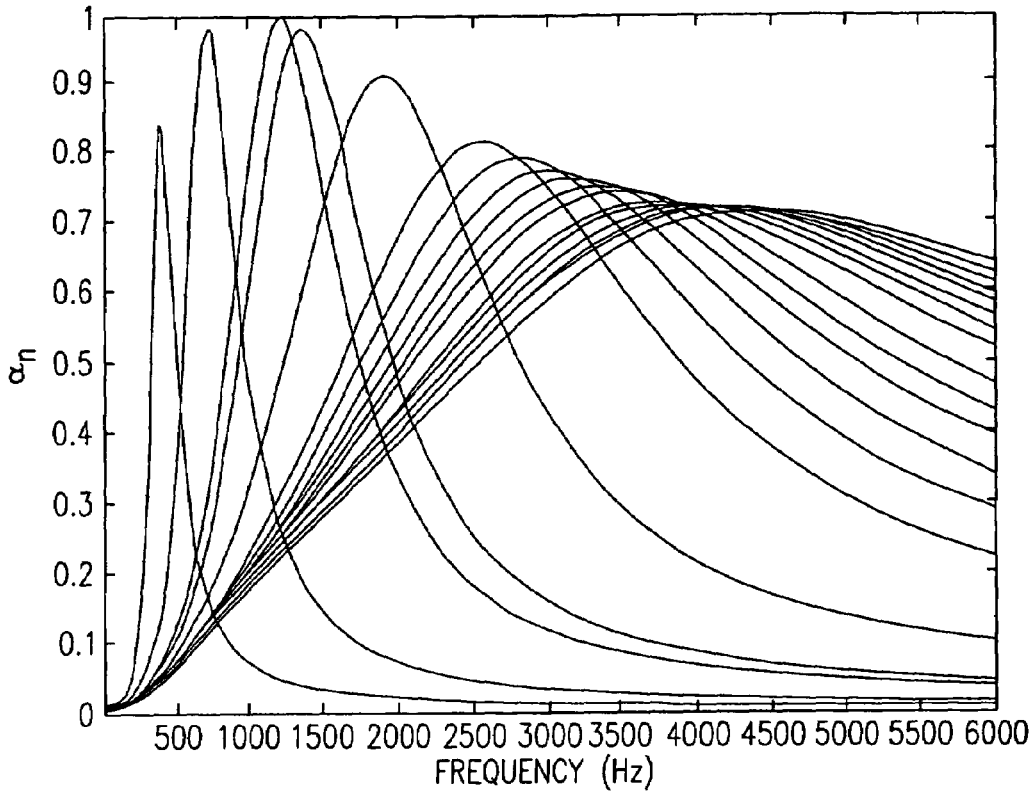
FIG. 6 is a graphic illustration of the sound absorption coefficient for a fiberglass blanket of a particular hole diameter and perforation percentage over a range of frequencies.

In FIG. 6, the 0.5 inch fiberglass blanket has a perforated film with hole diameters of 1 mm and a perforation percentage of 0.1% to 20%. The curve farthest to the left therefore represents the performance of a perforated film with a 0.1% perforation and the curve farthest to the right shows the performance for a film with 20% perforation. The other curves are representative of values between those two extremes.

Figure 7:
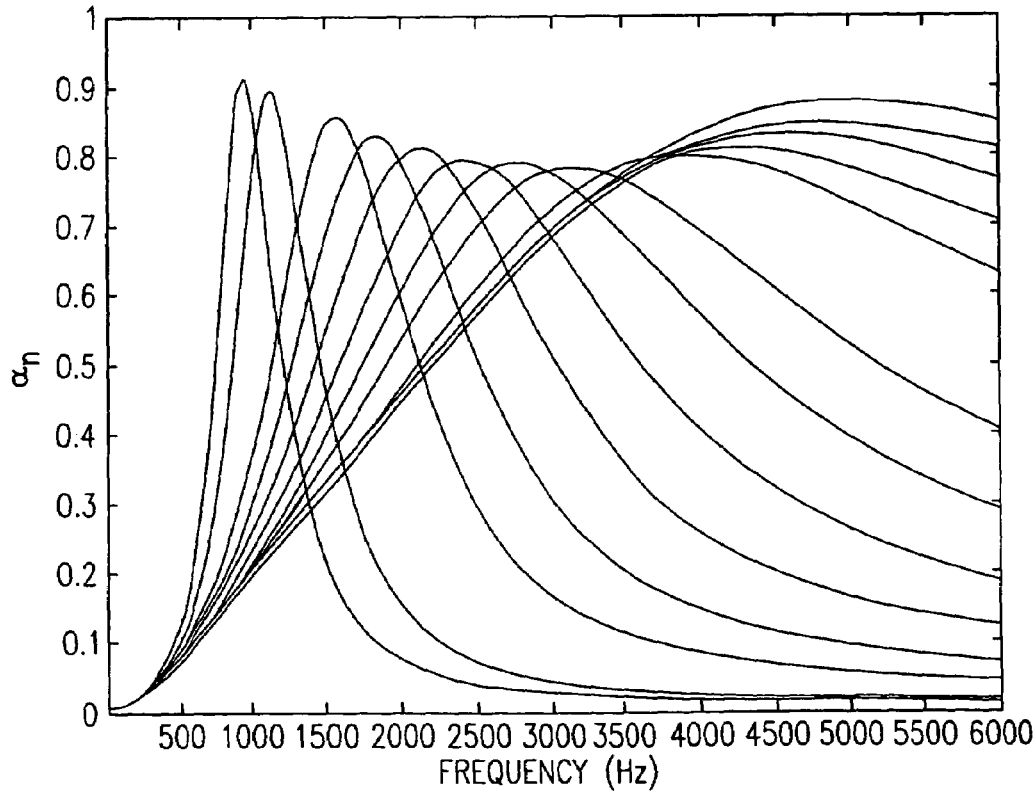
FIG. 7 is graphic illustration of the sound absorption coefficient of a fiberglass blanket of a different hole size and perforation percentage over a range of frequencies.

Referring to FIG. 7, a fiberglass blanket of 0.5 inches is covered with a perforated film having a 5% perforation rate and the hole diameters ranging from 0.1 mm to 10 mm. The curve farthest to the left is representative of performance of a film having a 0.1 mm diameter, while the curve farthest to the right represents the performance of a film having holes of 10 mm diameter. Again, the other curves are representative of values between those two extremes.

It will thus be seen from the data described hereinabove that the performance of the aluminum foil cover sheet can vary substantially over various frequency ranges by varying the hole diameter and/or the perforation percentage. Thus, it is important to, first of all, consider the frequency ranges that characterize the particular furnace and then to optimize both the hole diameters and the perforation percentage in the cover sheet in order to optimize the amount of sound absorption that can be accomplished with this technique. The models as discussed hereinabove are merely representatives of many design tools that may be used in order to obtain the optimized design.

We claim:

1. A residential furnace having at least one burner for providing heat to at least one heat exchanger disposed in a heat exchanger compartment, and a blower for circulating air through the heat exchanger compartment to heat the air, with the heat exchanger compartment being lined with a layered insulator comprised of a thermal insulation on its outer side and a heat reflective material on its inner side, wherein said heat reflective material has a plurality of holes formed therein, for allowing sound to pass from the heat exchanger compartment, through said plurality of holes and into said thermal insulation to be dissipated wherein said heat reflective material comprises an aluminum foil and further wherein the size of said plurality of holes is optimized for maximizing the sound absorption over a selected frequency range.

2. A residential furnace as set forth in claim 1 wherein said thermal insulation is composed of a fiberglass material.

3. A residential furnace as set forth in claim 1 wherein said heat reflective material is secured to said thermal insulation by an adhesive.

4. A residential furnace as set forth in claim 1 wherein the density of said holes in said heat reflecting material is optimized in order to maximize the sound absorption characteristics over a selected frequency range.

5. A residential furnace as set forth in claim 1 wherein said plurality of holes are formed in a uniformly distributed pattern.

6. A method of reducing noise in a residential furnace having at least one burner for heating air to be passed through at least one heat exchanger over which the air is passed by operation of a blower, with said at least one heat exchanger being disposed in a housing with walls having inner sides comprising the steps of:

providing in a first sheet of a relatively thick thermal insulation material that is capable of absorbing sound and a second sheet of a relatively thin material that is capable of reflecting heat;

attaching said first sheet to cover one side of said second sheet to form a layered insulation structure;

forming a plurality of holes in said second sheet to expose portions of said first sheet; and attaching said layered insulation structure to an inner side of at least one of said walls.

7. A method as set forth in claim 6 wherein said relatively thick thermal insulation material is formed of a fiberglass material.

8. A method as set forth in claim 6 wherein said relatively thin material is formed of an aluminum foil.

9. A method as set forth in claim 6 wherein said step of attaching said first sheet to cover one side of said second sheet is accomplished by way of an adhesive.

10. A method as set forth in claim 6 wherein said step of forming said plurality of holes is accomplished by sizing each of said plurality of holes so as to optimize the sound absorption characteristics as a function of the selected frequency ranges characteristic of the furnace.

11. A method as set forth in claim 6 wherein said step of forming said plurality of holes in said second sheet is accomplished by establishing a hole density so as to optimize the sound absorption characteristics over a selected frequency range characteristic of the furnace.

12. A furnace of the type having a heat exchanger compartment, a plurality of heat exchanger cells disposed in the heat exchanger compartment, a blower for passing air over the heat exchanger cells to be heated, a plurality of burners for introducing fuel/air mixtures to be ignited at one end of the heat exchanger cells and layered insulation disposed on the inner walls of the heat exchanger compartment, wherein improvement comprises:

said layered insulation having an outer layer formed of a relatively thick fiberglass thermal insulation material and an inner layer formed of a relatively thin heat reflective material, said inner layer having a plurality of holes formed therein for allowing sound from the heat exchanger compartment to pass therethrough and into said outer layer to be absorbed thereby wherein said inner layer is formed of an aluminum foil material and further wherein said plurality of holes are formed in a density such that the sound absorption characteristics are optimized for a selected frequency range characteristic of the furnace.

13. A furnace as set forth in claim 12 wherein said outer layer is formed of a fiberglass material.

14. A furnace as set forth in claim 12 wherein said inner layer is attached to said outer layer by way of an adhesive.

15. A furnace as set forth in claim 12 wherein said plurality of holes are formed with a diameter which is selected so as to optimize the sound absorption performance over a selected frequency range characteristic of the furnace.

16. A furnace as set forth in claim 12 wherein said plurality of holes are formed in a uniformly distributed pattern.

* * * * *